United States Patent [19]

Grosskrueger et al.

[11] Patent Number: 5,070,219

[45] Date of Patent: Dec. 3, 1991

[54] ELECTRICAL KEY LOCKED SWITCH

[76] Inventors: Duane D. Grosskrueger, 4281 E. Peakview Cir.; Dan Bliss, 6930 S. Yukon Way, both of Littleton, Colo. 80121

[21] Appl. No.: 513,065

[22] Filed: Apr. 23, 1990

[51] Int. Cl.[5] ..... H01H 43/00

[52] U.S. Cl. ..... 200/43.008; 200/43.001; 200/303; 200/51 R; 200/51 LM

[58] Field of Search ..... 200/303, 310, 317, 51 LM, 200/51 R, 43.01, 43.02, 43.08, 43.04

[56] References Cited

U.S. PATENT DOCUMENTS

| | | | |
|---|---|---|---|
| 1,648,202 | 1/1927 | Stange | 200/43.01 |
| 2,802,083 | 8/1957 | Lapeyre | 200/298 |
| 2,912,458 | 11/1959 | Wodal | 200/194 |
| 2,979,624 | 4/1961 | Askerneese | 200/51 LM |
| 3,453,402 | 7/1969 | Suber | 200/43.02 |
| 3,571,545 | 3/1971 | Haderer | 200/303 X |
| 3,614,363 | 10/1971 | Fujita | 200/303 |
| 4,081,641 | 3/1978 | Piber | 200/432 |
| 4,200,774 | 4/1980 | Nelms | 200/43.08 |
| 4,247,743 | 1/1981 | Hinton et al. | 200/43.02 |
| 4,323,762 | 4/1982 | Ervin et al. | 200/43.02 X |
| 4,336,418 | 6/1982 | Hoag | 174/53 |
| 4,463,228 | 7/1984 | Osika | 200/51 R |
| 4,482,789 | 11/1984 | McVey | 200/51 R |
| 4,612,423 | 9/1986 | Munroe | 200/16 R |
| 4,669,804 | 6/1987 | Munroe | 439/398 |

FOREIGN PATENT DOCUMENTS

| | | | |
|---|---|---|---|
| 2542107 | 3/1977 | Fed. Rep. of Germany | 200/51 LM |

*Primary Examiner*—Ernest G. Cusick

[57] ABSTRACT

An in line key-locked switch for a power cord for electronic equipment. The key locked switch may be easily connected to the power cord of electronic apparatus such as a television set to limit access to the electronic apparatus. The key locked switch, generally stated, comprises, a two piece protective outer casing including a base portion, and a nestable cover portion, a key actuated switch mounted within the outer casing, and piercing means mounted to the cover portion for piercing the cut separate ends of a lead of the power cord to provide electrical contact with the key actuated switch. The protective outer casing includes a piercing guide for engaging the separate lead wires of the power cord to hold the separate ends in position for piercing by the piercing means.

11 Claims, 2 Drawing Sheets

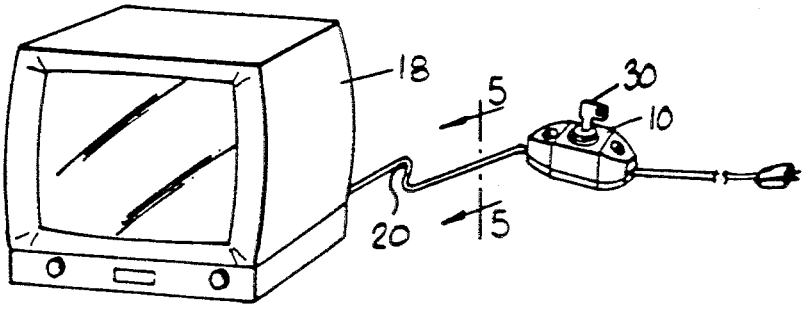
FIG. 1
FIG2
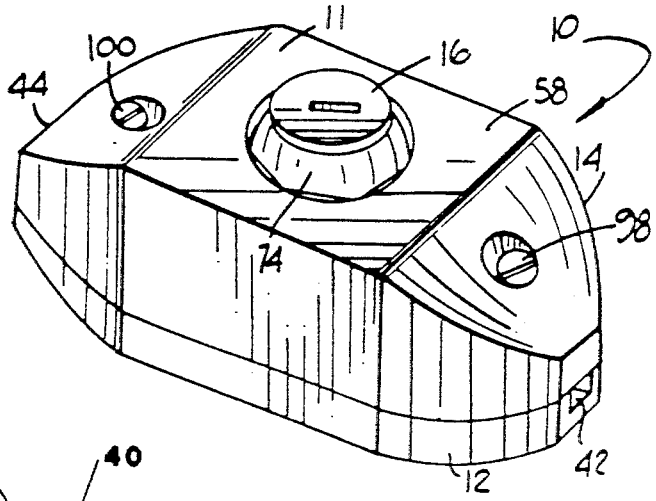
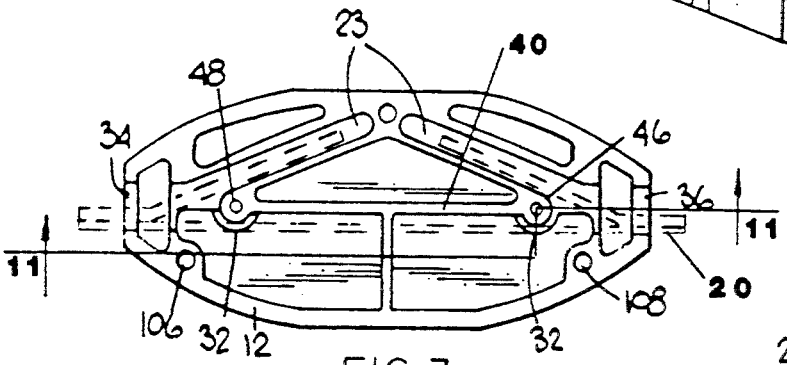
FIG.3
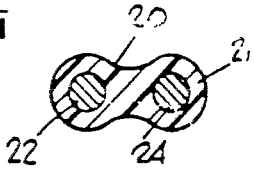
FIG.5
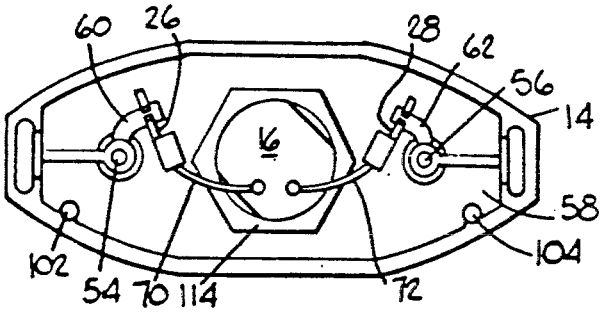
FIG.4
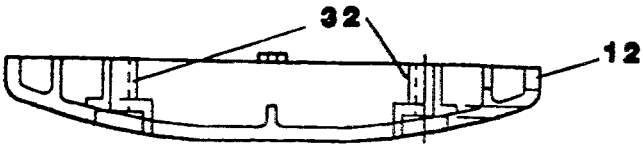
FIGURE 11

ELECTRICAL KEY LOCKED SWITCH

TECHNICAL FIELD

This invention relates to electrical devices and more particularly to a new and unobvious in line switch which may be retrofitted to an existing power cord of an electrical apparatus and key locked.

BACKGROUND ART

It is often desirable to lock out power to some electronic apparatus. This may be useful for limiting access to the electronic apparatus. In a manufacturing plant for instance, it is often necessary to limit access to electrical tools and machinery. In homes and apartments it may be necessary to limit access to an electrical appliance such as a television set. A parent could thus more easily control a child's television viewing habits.

In the past various electrical key locked switches have been proposed for locking out power to electrical apparatus. U.S. Pat. No. 3,453,402 to Suber for example, discloses a key locked switch constructed as a plug connector for a wall socket or the like. U.S. Pat. No. 4,200,774 to Nelms discloses a key locked switch for controlling power from an automotive electrical system.

A problem with these types of key locked switches is that in general they are difficult to install or retrofit to already manufactured electrical equipment. This is especially true if a relatively unskilled homeowner or retail consumer must retrofit the switch to an existing appliance such as a television set. Additionally, because of the size or configuration of these prior art switches, it may be difficult to locate the switch in a convenient position with respect to the appliance.

The present invention on the other hand, is directed to a key locked switch which may be easily retrofitted to a power cord of existing electrical equipment even by a relatively unskilled person such as an average homeowner.

DISCLOSURE OF THE INVENTION

In accordance with the present invention an in line key locked switch for electrical equipment is provided. The key locked switch is constructed to be easily attached to an existing power cord of existing electrical equipment and located anywhere along the length of the power cord.

The key locked switch of the invention generally stated, comprises, a two piece protective outer casing including a base portion and a cover portion, piercing means attached to the cover portion for electromechanically contacting a cut wire lead of the power cord and a key actuated switch in electrical contact with the piercing means for making or breaking power through the power cord. In addition the base portion of the outer casing is formed with a piercing guide means for holding and aligning the separate ends of the cut wire lead of the power cord for piercing.

In use of the key locked switch of the invention, one of two insulated wires of a power cord commonly found on electronic apparatus such as a television set, is cut where the switch of the invention is to be located. The separate ends of the cut power lead are then placed in a piercing guide formed on the base of the casing.

The cover portion of the outer casing is then fastened to the base portion utilizing threaded fasteners. As the cover portion of the outer casing is tightened to the base portion, the separate wires of the power cord are clamped between the cover portion and the base portion and the piercing means attached to the cover portion pierces the insulation of the cut power lead and electromechanically connects the ends of the cut power lead with the key actuated switch.

The key locked switch of the invention can thus be easily attached anywhere along the length of a power cord without the necessity of opening the interior of the electronic apparatus. In addition the piercing guide and piercing means of the invention facilitate electrical connection of the key locked switch in line with the power cord. Moreover, the key locked switch can be located external to the electrical apparatus anywhere along the length of the power cord.

In an alternate embodiment of the invention, the key locked switch is mounted in a separate casing and can be remotely located with respect to the power cord.

Many other objects, advantages, and purposes of the invention will become apparent from the following detailed description of the drawing.

BRIEF DESCRIPTION OF THE DRAWING

FIG. 1 is a perspective view of a key locked switch constructed in accordance with the invention shown installed to the power cord of a television set;

FIG. 2 is a perspective view of a key locked switch constructed in accordance with the invention;

FIG. 3 is a plan view of a base portion of the key locked switch of FIG. 2;

FIG. 4 is a plan view of a cover portion of the key locked switch of FIG. 2;

FIG. 5 is a cross section of the power cord taken along section line 5-5 of FIG. 1;

FIG. 11 is a cross sectional view taken along section line 11-11 of FIG. 3.

BEST MODE FOR CARRYING OUT THE INVENTION

Figure 6:
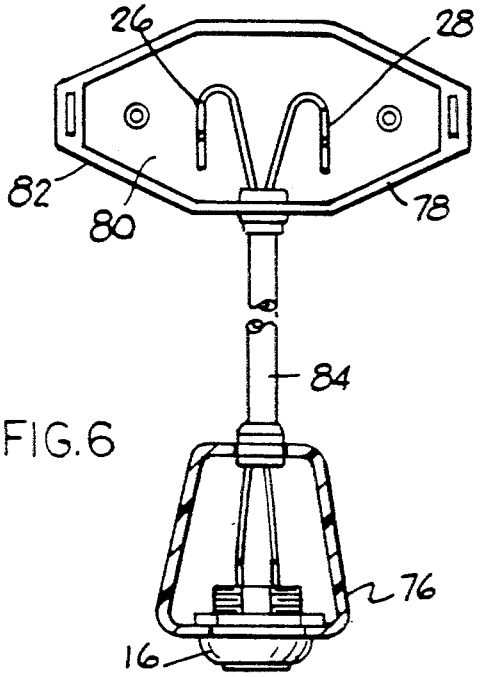
FIG. 6 is a schematic plan view with parts removed of a remote mounted key locked switch constructed in accordance with an alternate embodiment of the invention.

Referring now to FIGS. 1–5 a key locked switch 10 constructed in accordance with the invention is shown. As shown in FIGS. 2–4, the key locked switch 10, generally stated, comprises, a protective outer casing 11 including a base portion 12 and a cover portion 14, key actuated switch means in the form of a key actuated switch 16 mounted within the outer casing 14, and piercing means in the form of piercing spades 26, 28 (FIG. 4) attached to the cover portion 14 of the protective outer casing 11 for electromechanically contacting a power cord 20 (FIG. 1) of an electronic apparatus such as a television set 18. Additionally, the key locked switch 10 includes piercing guide means in the form of a piercing guide 23 (FIG. 3) for holding and aligning the separate ends of a cut wire lead 22 (FIG. 5) of the power cord 20 for piercing.

As shown in FIG. 5, the power cord 20 is a two conductor wire and may include an outer insulation 21 and two separate power leads 22, 24. Alternately, a key locked switch 10 constructed in accordance with the invention may be installed on a power cord which includes a third wire (three conductor wire) which functions as a common ground for the power cord 20.

With reference to FIGS. 1–5, installation of the key locked switch 10 of the invention on a two conductor power cord 20 of electronic equipment such as a television set 18 can be accomplished by the steps of:

1. Splitting a portion of the insulation 21 of the power cord 20, (example 3 inches) to separate the separate wire leads 22, 24 of the power cord 20.
2. Cutting a first wire lead 22 of the power cord 20.
3. Placing the separate ends of the cut first wire lead 22 of the power cord 20 in a two prong channel-like piercing guide 23 (FIG. 3) formed on the base portion 12 of the lockable switch 10.
4. Placing the second wire lead 24 of the power cord 20 through a wire guide means 32 (FIG. 3) formed on the base portion 12.
5. Clamping the cover portion 14 to the base portion 12 such that the piercing means and in particular the piercing spades 26, 28 attached to the cover portion 14 pierce the insulation 21 of the power cord 20 and electrically contact the separate ends of the cut wire lead 22. The piercing spades 26, 28 in turn are electrically connected to the key switch 16.

The piercing guide 23 in general functions to correctly space and align the cut wire lead 22 with the piercing spades 26, 28 and hold the cut wire lead 22 of the power cord 20 for piercing.

Once installed on a power cord 20 of an electronic apparatus such as a television set 18, the key actuated switch 16 of the key locked switch 10 of the invention makes or breaks electrical power through the power cord 20. The key actuated switch 16 is constructed with a locking tumbler (not shown) having a mating key 30 (FIG. 1). Rotation of the key 30 of the key actuated switch 16 to an "off" position or to an "on" position thus controls power to the television set 18.

The protective outer casing 11 of the key locked switch 10 is preferably constructed of a sturdy electrically insulating material such as molded plastic. One such suitable material is a polycarbonate material manufactured by GE Plastics under the trademark "LEXAN 940".

Referring now to FIG. 3, the construction of a base portion 12 of the protective outer casing 11 in one embodiment of the invention is clearly shown. The base portion 12 of the protective outer casing 11 has a multisided outer peripheral configuration which corresponds in shape to the outer peripheral configuration of the cover portion 14.

A piercing guide 23 is formed on the molded base portion 12 for receiving the separate ends of the cut wire lead 22 of the power cord 20 for piercing. The piercing guide 23 retains the cut wire lead 22 of the power cord 20 and is formed to precisely align the separate ends of the cut wire lead 24 with the piercing spades 26, 28. The piercing guide 23 thus functions as a piercing guide means for the cut wire lead 24 of the power cord 20.

A solid partition 40 (FIG. 3) in the piercing guide 23 maintains separation of the separate ends of the cut wire lead 22. The piercing guide 23 is formed to be large enough to accommodate a wire lead of a size most commonly used with various electronic equipment such as television sets 18.

Wire guide means 32 are also formed or molded integrally on the base portion 12 and function as a guide or retainer for the uncut or continuous wire lead 24 of the power cord 20. With the cover portion 14 attached to the base portion 12, openings 42, 44 (FIG. 2) for the power cord 20 are formed into the protective outer casing at each end 34, 36 of the protective outer casing 11.

The protective outer casing 11 of the key locked switch 10 also includes attachment means for removably attaching the cover portion 14 to the base portion 12. The attachment means may include two support members 46, 48 (FIG. 3) formed or molded integrally on the base portion 12. The support members 46, 48 extend generally perpendicularly from the base portion 12 and have a generally cylindrical configuration with an inside diameter and an outside diameter. The inside diameters of the cylindrical support members 46, 48 are sized for receiving threaded fasteners such as machine screws 98, 100 (FIG. 2) which are first passed through countersunk openings 54 or 56 (FIG. 4) in the cover portion 14 of the outer casing 11. The machine screws 98, 100 are fastened with mating threaded nuts (not shown) which may be retained in corresponding shaped countersunk openings formed on the bottom surface of the base portion 12.

With the cover portion 14 attached to the base portion 12, the separate wires 22, 24 of the power cord are sandwiched or clamped in the piercing guide 23 of the base portion 12. Alternately, other attachment means for attaching the cover portion 14 to the base portion 12 such as threaded openings, hinges, snaps, or snap fits may also be utilized.

The cover portion 14 of the lockable switch 10 is formed with an outer peripheral configuration which matches the outer peripheral configuration of the base portion 12 of the protective outer casing 11. The cover portion 14 is thus nestable with the base portion 12.

Alignment means are formed on the protective outer casing 11 for clocking or precisely aligning the cover portion 14 with the base portion 12. In the form of the invention shown in FIGS. 1–6 the alignment means include alignment pins 102, 104 (FIG. 4) formed on the cover portion 14 which mate with matching alignment openings 106, 108 (FIG. 3) formed on the base portion 14. The alignment means in addition to aligning the cover portion 14 with the base portion 12 insure that the piercing spades 26, 28 precisely align with the separate ends of the cut wire lead 22 which is held in the piercing guide 23.

The cover portion 14, as shown in FIG. 4, also includes a pair of spaced, piercing support members 60, 62 formed or integrally molded on the upper wall 58 of the cover portion 14 of the outer casing 11. The support members 60, 62 include a slot for mounting the piercing spades 26, 28. The piercing spades 26, 28 are preferably formed of a thin metallic material which has the characteristics of a leaf spring. The natural spring of the material along with the shape of the piercing spades 26, 28 hold the piercing spades 26, 28 on the support members 60, 62. A suitable shape for the piercing spades 26, 28 is shown in FIG. 10.

Figure 10:
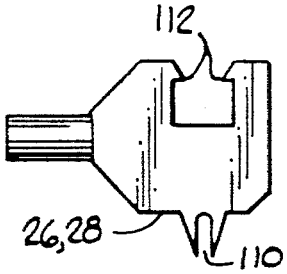
FIG. 10 is a side elevation view of a piercing spade component constructed in accordance with the invention.

With reference to FIG. 10, the piercing spades 26, 28 are flat irregularly shaped electrical contacts formed of an electrically conductive material such as brass or copper. Each piercing spade 26, 28 is formed with a pointed or serrated projection 10 for piercing the insulation 21 of the power cord 20 to electromechanically contact the cut wire lead 22 of the power cord 20 of the television set 18 or other electronic equipment. Additionally each piercing spade 26, 28 may include a barbed shaped portion 112 formed for holding the piercing spade 26 or 28 on the piercing support members 60, 62 of the cover portion 14.

Contact wires 70, 72 are soldered or otherwise attached to the piercing spades 26, 28 at one end and to the key actuated switch 16 at the other end. The piercing spades 26, 28 are thus electrically connected to the separate contacts of the key actuated switch 16.

As previously stated, the key actuated switch 16 is a commercially available make or break switch adapted to be manipulated by a key 30 (FIG. 7) operated through a locking tumbler (not shown) and held in either an on or an off position. By way of example only, and not by limitation, one such suitable key actuated switch is manufactured by C & K Components, of Clayton, N.C., designated as part no. Switchlock P/N P101 1U2 WM SC N Q-02.

As shown in FIG. 2, the key actuated switch 16 has a generally cylindrical outer configuration, and is formed with a threaded stud having mounting flats on either side. The key actuated switch 16 is retained in a corresponding "double D" opening formed in the upper wall 58 of the cover portion 14. A threaded nut member 114 (FIG. 4) and a collar member 74 (FIG. 2) formed on the key actuated switch fasten the key actuated switch 16 to the cover portion 14. Alternately other fastening means such as snap rings or press fit arrangements can also be utilized to attach the key actuated switch 16 to the cover portion 14.

As constructed, the key locked switch 10 of the invention can be placed in line with the power cord 20, of an electronic apparatus such as the television set 18, anywhere along the length of the power cord 20. Alternately, in another embodiment of the invention and as shown in FIGS. 6 and 9, the key actuated switch 16 can be located in a remote switch enclosure 76 which is separate from a piercing enclosure 78.

The alternate embodiment piercing enclosure 78 may be formed with a cover portion 80 and a base portion 82 similar in construction to the cover portion 14 and the base portion 12 previously described. A two conductor wire 84 electrically connects the piercing spades 26, 28 to the key actuated switch 16 mounted in remote enclosure 76.

Figure 9:
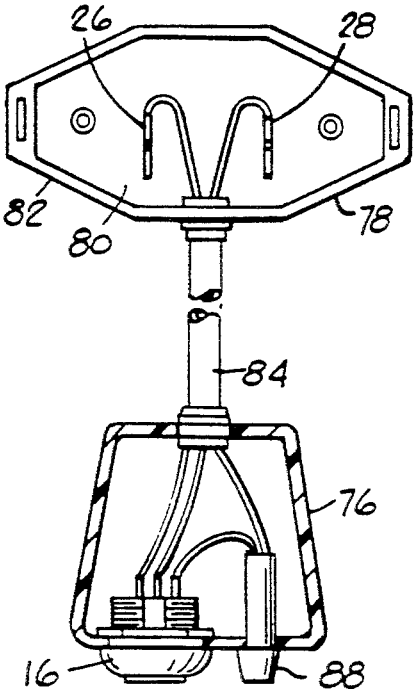
FIG. 9 is a schematic plan view with parts removed of a remote mounted key locked switch constructed in accordance with an alternate embodiment of the invention having an indicator light.

Additionally and as shown in FIG. 9, the remote switch enclosure 76 may include indicator means such as an indicator light 88 which may be electrically connected to the key actuated switch 16 to indicate when the switch is in either an "on" or "off" position.

Figure 7:
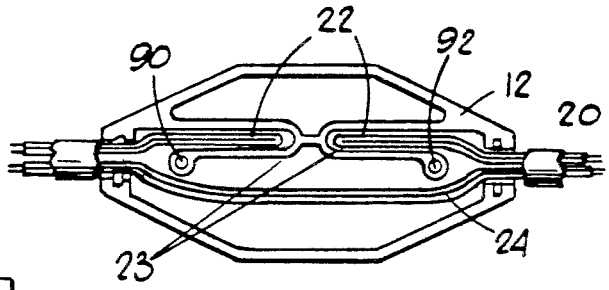
FIG. 7 is a schematic plan view of a base portion of a key locked switch constructed in accordance with the invention showing a typical wiring arrangement through the base portion for a two conductor power cord.
Figure 8:
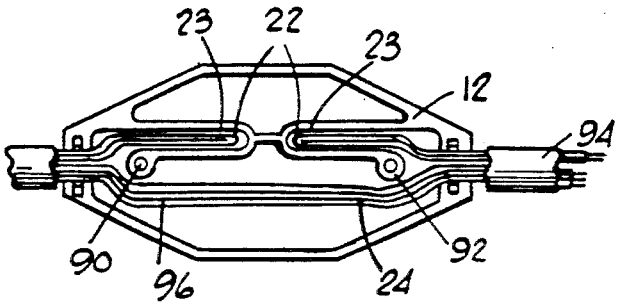
FIG. 8 is a schematic plan view of a base portion of a key locked switch constructed in accordance with the invention showing another typical wiring arrangement through the base portion for a three conductor power cord.

In FIGS. 7 and 8 different wiring arrangements through the base portion 12 are shown. As shown in FIGS. 7 and 8, guide tabs 90, 92 formed on the base portion 12 function as wire guide means 32 to guide or retain the continuous wire lead 24 of the power cord 20 in a correct placement on the base portion 12.

In FIG. 8, a wiring arrangement for a three conductor wire power cord 94 is shown. For a three conductor wire power cord 94, a continuous uncut wire lead 24 along with a separate ground wire 96 are placed through the base portion 82 and again held in place by the guide tabs 90, 92.

Thus the invention provides a key locked switch which can be easily connected in line with an existing power cord to make or break power through the cord. The switch of the invention can be mounted either on the power cord or at a location remote form the power cord. Once installed access to the electronic apparatus can be limited as required.

Many changes and modifications in the above described embodiments of the invention can of course be carried out without departing from the scope thereof. Accordingly that scope is intended to be limited only by the scope of the appended claims.

What is claimed is:

1. An electrical key locked switch for a power cord of an electronic apparatus having at least two separate power leads comprising;

a protective outer casing formed of an electrically insulating material and including a base portion and a cover portion;

wire guide means formed on the base portion for retaining a first continuous lead of the power cord;

piercing guide means formed in the base portion for receiving two separate ends of a cut second lead of the power cord for retaining the separate ends of the cut second lead for piercing;

a first piercing spade attached to the cover portion and aligned with said piercing guide means and having a pointed projection for piercing a first end of the cut second lead of the power cord;

a second piercing spade attached to the cover portion and aligned with said piercing guide means and having a pointed projection for piercing a second end of the cut second wire of the power cord;

a key actuated electrical switch having contacts electrically connected to said first and said second piercing spades and which may be switched by a key lock to an "on" or an "off" position; and attachment means for attaching the cover portion to the base portion to clamp the power cord and pierce the cut wire lead of the power cord.

2. The key locked switch as claimed in claim 1 and wherein:

said key actuated electrical switch is mounted on the cover portion of said protective outer casing.

3. The key locked switch as claimed in claim 1 and wherein:

said key actuated electrical switch is mounted in an enclosure separate from said protective outer casing.

4. The key locked switch as claimed in claim 2 and wherein:

said attachment means includes threaded fasteners placed through openings in said base portion and said cover portion and attached to mating threaded nuts retained in countersunk openings in the base portion of said protective outer casing.

5. The key locked switch as claimed in claim 1 and further comprising:

alignment means for precisely aligning said cover portion with said base portion.

6. The key locked switch as claimed in claim 5 and wherein:

said piercing spades are formed of leaf-spring like material attached to support members formed on said cover portion.

7. The key locked switch as claimed in claim 6 and wherein:

said piercing spades are formed with a serrated edge for contacting the cut wire leads of the power cord.

8. An electrical key locked switch for a power cord of an electronic apparatus having at least two separate power leads comprising:

a protective outer casing formed of an electrically insulating material and including a base portion and a nestable cover portion;

wire guide means formed in the base portion for retaining a first continuous lead of the power cord;

piercing guide means formed on the base portion for receiving a second lead of the power cord which is cut to form separate ends;

a first and a second piercing spade mounted on the cover portion of said protective outer casing and aligned with said piercing guide means and having pointed projections for piercing the separate ends of the cut second wire of the power cord;

a key actuated electrical switch mounted within said cover portion and having contacts electrically connected to said first and said second piercing spades and lockable in an "on" position or an "off" position, so that the separate leads of the power cord may be separated and a first wire lead of the power cord placed in said wire guide means and a second wire lead of the power cord may be cut and the separate ends placed in said piercing guide means and pierced by said first and second piercing spades to provide electrical contact with said key actuated electrical switch.

9. The electrical switch as claimed in claim 8 and further comprising:

alignment means for aligning the base portion and the cover portion of said protective outer casing.

10. The electrical switch as claimed in claim 9 and wherein:

said alignment means comprises alignment pins formed on the cover portion which align with mating alignment openings formed on the base portion.

11. The electrical switch as claimed in claim 10 and wherein:

the base portion is attached to the cover portion of said outer casing with threaded fasteners.

* * * * *